US008116479B2

(12) United States Patent
Hamada et al.

(10) Patent No.: US 8,116,479 B2
(45) Date of Patent: Feb. 14, 2012

(54) SOUND COLLECTION/REPRODUCTION METHOD AND DEVICE

(75) Inventors: Hareo Hamada, Tokyo (JP); Yoshitaka Murayama, Tokyo (JP); Akira Goto, Tokyo (JP)

(73) Assignee: Dimagic Co., Ltd., Tokyo (JP)

( * ) Notice: Subject to any disclaimer, the term of this patent is extended or adjusted under 35 U.S.C. 154(b) by 446 days.

(21) Appl. No.: 12/094,491

(22) PCT Filed: Nov. 20, 2006

(86) PCT No.: PCT/JP2006/323953

§ 371 (c)(1),
(2), (4) Date: Sep. 25, 2009

(87) PCT Pub. No.: WO2007/066570

PCT Pub. Date: Jun. 14, 2007

(65) Prior Publication Data

US 2010/0027808 A1 Feb. 4, 2010

(30) Foreign Application Priority Data

Dec. 5, 2005 (JP) ..... 2005-351359

(51) Int. Cl.
*H04R 3/00* (2006.01)

(52) U.S. Cl. ..... 381/92

(58) Field of Classification Search ..... 381/92, 381/94.1, 94.3, 56, 58, 23; 700/94
See application file for complete search history.

(56) References Cited

U.S. PATENT DOCUMENTS

| | | | | |
|---|---|---|---|---|
| 6,625,587 | B1 * | 9/2003 | Erten et al. | 706/22 |
| RE39,189 | E * | 7/2006 | Poletti | 381/63 |
| 7,274,794 | B1 * | 9/2007 | Rasmussen | 381/92 |
| 2004/0105559 | A1 * | 6/2004 | Aylward et al. | 381/103 |
| 2006/0159052 | A1 * | 7/2006 | Koga et al. | 370/335 |
| 2008/0273723 | A1 * | 11/2008 | Hartung et al. | 381/302 |
| 2009/0196365 | A1 * | 8/2009 | Takano | 375/260 |
| 2010/0119081 | A1 * | 5/2010 | Aylward | 381/98 |

* cited by examiner

*Primary Examiner* — Hai Phan

(57) ABSTRACT

To provide a sound collection system using a plurality of microphones arranged in the proximity to one another and having an excellent directivity for an arbitrary position in the sound field space. A plurality of control points are set around a plurality of sound collecting microphones. A desired response function matrix A (ω) and a transfer function matrix C (ω) between the control points and the respective microphones are measured. A control filter H arranged in a digital signal processing unit (2) is connected to each of the microphones constituting the sound collection device (1). The control filters H are arranged for the number of output channels of a reproduction unit (4). An output of each of the control filters H is added for each channel and outputted to each channel of the reproduction unit (4). By specifying a microphone directivity upon sound collection at a control point, the control filters H are decided according to the measured desired response function matrix A (ω) and the transfer function matrix C (ω) of the specified control point.

6 Claims, 6 Drawing Sheets

SOUND COLLECTION/REPRODUCTION METHOD AND DEVICE

TECHNICAL FIELD

The present invention relates to a sound collection/reproduction method and device capable of collecting sound with directivity in an arbitrary direction by using an array of microphones which are arranged in proximity to one another and of reproducing the collected sound in an arbitrary reproduction system with a different number of channels and a different reproduction device.

BACKGROUND

A microphone array device which employs a plurality of microphones as sound collection devices in a sound field is known. A technology which targets sound signals which are to be collected in targeted positions from among sound signals which are collected from microphones which are actually arranged instead of actually installing microphones and collecting sound in that manner has been proposed with the object of reducing the number of microphones in the microphone array device. The invention of Patent Document 1 is representative of this technology and estimates the sound collection signals in arbitrary positions in dimensional directions in the number of two microphones for each dimension.

According to the invention of Patent Document 1, as shown in FIG. 6, two microphones 10*a* and 10*b* are arranged in an axial direction and sound signals which are collected thereby are input to a received sound signal estimation processing unit 11. The received sound signal estimation processing unit 11 approximates the sound waves which arrive at the two microphones from the sound source to planar waves, renders an approximation of the estimated received sound signals in a position which is coaxial with the microphones 10*a* and 10*b* by means of a wave equation, estimates the coefficient b cos θ of the wave equation which is dependent on the direction of arrival of the sound waves of the wave equation by estimating the average power of the sound waves arriving at the two microphones to be equal, and estimates the received sound signals from the two microphones in an arbitrary position which is coaxial with the microphones on the basis of the received sound signals.

Patent Document 1: Japanese Unexamined Patent Publication No. 2001-45590

Furthermore, the invention of Patent Document 1 performs signal processing which approximates the signals arriving at the two microphones from the sound source as planar waves. However, the sound waves in the actual sound field are not limited to being planar waves, meaning that the estimated positions of the received sound signals cannot be accurately obtained.

In addition, although detecting the phase difference, time difference, and frequency difference of the sounds collected by a plurality of microphones and estimating the received sound signals in an arbitrary position based on these differences may also be considered, in this case, when the plurality of microphones are arranged in proximity to one another, the detected value for the phase difference or the like is diminished and erroneous effects are readily introduced, making an accurate estimate difficult.

Furthermore, generally speaking, in the field of sound collection or the editing field, the setting of the sound amount is in a suitable state and the setting conditions for the sound collection and editing cannot be improved and must always be confirmed. For example, in cases where sound collection for a 5.1-channel surround system is carried out, a 5.1-channel reproduction system must actually be prepared and monitored. However, it is difficult to prepare a bulky reproduction system of this kind in the sound collection field and monitoring has generally been performed using headphones or two-channel monitor speakers. However, it has hitherto not been possible to confirm the status (the magnitude of the sound and the quality of each image fixed position) of each channel (the sound in each direction) of multichannel collected sound using conventional two-channel headphones or speakers.

DISCLOSURE OF THE INVENTION

The present invention was proposed in order to solve the above problems of the prior art and an object of the present invention is to provide a sound collection system which makes it possible to enhance and sample sounds arriving from arbitrary directions in a state where a plurality of microphones are arranged in proximity to one another (the curvature of the arriving wave plane is not limited to a parallel planar wave and can arbitrarily correspond to a spherical wave of an arbitrary curvature).

More specifically, the present invention provides a sound collection system which is capable of collecting sounds with an emphasis on sounds from arbitrary directions (the directivity of the microphones is directed in arbitrary directions) by signal-processing signals which are input to the plurality of microphones arranged in proximity to one another.

A further object of the present invention is to provide a sound collection system which is capable of obtaining a two-channel output as a result of inputting, to a virtual sound source reproduction processing unit, the output of N channels obtained as a result of signal-processing the signals which are input via each of the microphones, and monitoring this two-channel output by means of headphones or two-channel speakers.

Yet another object of the present invention is to provide a sound collection/reproduction system which is compatible with generally widespread reproduction systems or reproduction systems that will be developed in the future such as a 5.1-channel surround system or stereo system, or a virtual sound source reproduction processing unit, for example, by connecting the sound collection system to an arbitrary reproduction system with a different number of channels and a different reproduction device.

The invention of claim 1 is a sound collection/reproduction system according to which a plurality of sound collection devices are arranged in proximity to one another, control filters in a number corresponding to the number of reproduction channels are connected to each of the microphones, the output signals from the control filters of each of the channels are added for each of the channels and output from each of the reproduction channels, wherein the control filters are obtained by setting a plurality of control points in a sound field around the plurality of sound collection devices arranged in proximity to one another, determining a desired response function matrix and a transfer function matrix between the control points and each of the sound collection devices on the basis of measurement values, and, in cases where the directivity of the sound collection devices is designated, determining values of the control filters on the basis of the desired response function matrix and transfer function matrix between the control points corresponding to the designated directivity and each of the sound collection devices.

The invention of claim 2 is the invention according to claim 1, wherein the control filter is represented by $H(\omega)=[C(\omega)^T \cdot C(\omega)]^{-1} C(\omega)^T \cdot A(\omega)$, where the control filter matrix is $H(\omega)$, the desired response function matrix is $A(\omega)$, and the transfer function is $C(\omega)$, and is obtained by solving the inverse matrix $[C(\omega)^T \cdot C(\omega)]^{-1} C(\omega)^T$ of the transfer function matrix $C(\omega)$.

The invention of claim 3 is the invention according to claim 1 or 2, wherein only the signal of the channel for which monitoring is performed is designated and extracted from among the signals of each of the channels from the adders of each of the channels, and the extracted channel signal is output to a two-channel speaker or headphones.

The invention of claim 4 is the invention of claim 3, wherein the virtual sound source reproduction processing unit divides the signals of each of the channels for use as left and right output signals of the reproduction device, and outputs the divided left and right signals of each of the channels to left and right reproduction devices via the control filters conforming to the characteristic of the reproduction device.

The invention of claim 5 is a sound collection/reproduction device having a plurality of sound collection devices arranged in proximity to one another, a digital signal processing unit which processes sounds collected by each of the sound collection devices, and a reproduction output unit which outputs a speech signal which is output by the digital signal processing unit, wherein the reproduction output unit is provided with reproduction devices of one or a plurality of channels, and the digital signal processing unit is provided with control filters in a number corresponding to the number of reproduction channels connected to each of the plurality of sound collection devices, and adders in a number corresponding to the number of channels, which add the outputs of the control filters of each of the reproduction channels connected to each of the sound collection devices for each channel, the outputs of the adder of each of the channels being connected to the reproduction devices of each of the channels of the reproduction processing unit.

In addition, the control filters are obtained by setting a plurality of control points in a sound field around the plurality of sound collection devices arranged in proximity to one another, determining a desired response function matrix and a transfer function matrix between the control points and each of the sound collection devices on the basis of measurement values, and, in cases where the directivity of the sound collection devices is designated, determining values of the control filters on the basis of the desired response function matrix and transfer function matrix between the control points corresponding to the designated directivity and each of the sound collection devices, and the digital signal processing unit is provided with a directivity control unit to which directivity control data are input in order to determine the directivity during sound collection by controlling the control filters.

The invention of claim 6 is the invention of claim 5, wherein the control filter is represented by $H(\omega)=[C(\omega)^T \cdot C(\omega)]^{-1} C(\omega)^T \cdot A(\omega)$, where the control filter matrix is $H(\omega)$, the desired response function matrix is $A(\omega)$, and the transfer function is $C(\omega)$, and is obtained by solving the inverse matrix $[C(\omega)^T \cdot C(\omega)]^{-1} C(\omega)^T$ of the transfer function matrix $C(\omega)$.

The invention of claim 7 is the invention of claim 5 or 6, wherein a monitoring processing unit is connected to the digital signal processing unit, the monitoring processing unit being provided with a virtual sound source reproduction processing unit which converts the signal from the adder of each of the channels provided in the digital signal processing unit into an output signal of a two-channel monitoring device.

The invention of claim 8 is the invention of claim 7, wherein the virtual sound source reproduction processing unit comprises a control filter which divides the outputs from the adder of each of the channels provided in the digital signal processing unit into two to match two left and right channels of the monitoring device, and sets a filter coefficient corresponding to the monitoring device for each of the two divided left and right signals of each of the channels, left and right adders which add the outputs from the control filters of each of the channels, and an output unit which outputs signals from the left and right adders to each of the channels of the monitoring device.

The present invention constituted as described hereinabove affords the following effects. (1) Because microphones are arranged in closer proximity to one another than is the case with the existing systems, the physical scale of the whole system can be minimized. (2) Miniaturization is also possible from the perspective of data storage. (3) Since, information on the whole of the space sound field can be saved, compatibility with the existing sound field reproduction systems as well as the sound field reproduction systems that will be developed in the future is possible. (4) Cooperation with a virtualized (virtual sound source reproduction) system is straightforward and effective. (5) The sound collection status of each channel can be monitored by means of two-channels or headphones in a multichannel sound collection system which collects sound with an emphasis on sounds in a plurality of directions.

BEST MODE FOR CARRYING OUT THE INVENTION

An embodiment of the sound collection/reproduction system of the present invention will be described next in specific terms with reference to the drawings.

(1) Example of Sound Collection Device

FIG. 1 shows an example of four microphones M1 to M4 which constitute a sound collection device 1 of this embodiment. Hence, these microphones M1 to M4 are housed in the holder 11 with the sound collection side oriented in the same direction.

The intervals between the respective microphones M1 to M4 are desirably intervals shorter than one quarter wavelength of the collected sound wave from the standpoint of the spatial sampling and the respective microphones M1 to M4 are disposed at a gap of about 10 mm in cases where the collected sound waves are in the audio bandwidth. However, the measurements are not restricted to those of this embodiment and may also range from about 100 mm to from 50 to 1 mm depending on the field of application. The number of channels from which sound is collected (the number of microphones) may be two or more.

(2) Reproduction/Equalizing Circuit

An example of an algorithm which is used in the sound collection/reproduction system of the present invention will be described by means of the reproduction/equalizing circuit shown in FIG. 2. The output sides of the respective microphones M1 to M4 are connected to the reproduction/equalizing circuit shown in FIG. 2. The reproduction/equalizing circuit is constituted by the desired response A which outputs a target signal, a transmission system C and a control filter H which are connected in parallel to the desired response A, and an adder Σ which adds the outputs from the desired response A and the control filter H and outputs an error e.

The desired response A is determined by the transfer function matrix $A(\omega)$ which is rendered by Equation (1) below.

$$A(\omega)=[A_1(\omega)\ A_2(\omega)\ \ldots\ A_q(\omega)] \quad \text{[Equation 1]}$$

Here, the desired response matrix A(ω) is acquired in a state where microphones M1 to M4 are arranged in the sound collection position of the sound field space by setting q control points around the microphones M1 to M4 as shown in FIG. 3 and measuring the impulse response from each control point. In this case, in FIG. 3, although the 360° range around the microphones M1 to M4 is measured at 15° intervals, the number of control points is not necessarily limited to this number. In addition, although the distance between the microphones M1 to M4 and each of the control points is also 1 meter, there are no particular restrictions on this distance. In addition, the desired response in locations other than each of these measured control points is acquired through calculation by means of interpolation or the like.

This transmission system C is determined, by means of the transfer function matrix C(ω) which is expressed by Equation 2 below.

$$C(\omega)=\begin{bmatrix} C_{11}(\omega) & \dots & C_{1M}(\omega) \\ \vdots & \iddots & \vdots \\ C_{N1}(\omega) & \dots & C_{NM}(\omega) \end{bmatrix} \quad \text{[Equation 2]}$$

Here, $C_{11}(\omega) \dots C_{1M}(\omega)$ indicates the transmission coefficient between the first control point and each of the microphones and M indicates the number of control points. In addition, $C_{N1}(\omega) \dots C_{NM}(\omega)$ indicates the transmission coefficient between the Nth control point and each of the microphones. The transmission coefficient $C_{11}(\omega) \dots C_{1M}(\omega)$ is determined by measuring the transmission characteristic (attenuation and lag and so forth) between each of the microphones M1 to M4 and each of the control points.

The control filter H is determined by Equation 3 below on the basis of the desired response transfer function matrix A(ω) and the transfer function matrix C(ω).

$$H(\omega)=[C(\omega)^T \cdot C(\omega)]^{-1} C(\omega)^T \cdot A(\omega) \quad \text{[Equation 3]}$$

In other words, as is evident from each of the above equations, because A(ω) which is contained in the control filter H is subtracted from the desired response transfer function matrix A(ω) by the adder Σ in the reproduction/equalizing circuit of FIG. 2, the inverse matrix $[C(\omega)^T \cdot C(\omega)]^{-1} C(\omega)^T$ of the transfer function matrix C constituting the control filter H may be solved by means of an approximate calculation such as the least-squares method in order to obtain the control filter H which minimizes the error e output from the reproduction/equalizing circuit. In this case, various numerical calculation methods such as the steepest descent method can be applied as a least-squares method-based solution.

(3) Overall Constitution of the Sound Collection/Reproduction System

As shown in FIG. 4, the sound collection/reproduction system of this embodiment is constituted by combining a monitoring system and a reproduction system with such a plurality of microphones and control filter H which is connected to the output sides of each of the microphones. Although four microphones are shown as sound collection devices in FIG. 1, the number of sound collecting microphones is M and the number of reproduction channels is N in the embodiment in FIG. 4.

In FIG. 4, 1 is a sound collection device, 2 is a digital signal processing unit, 3 is a monitoring processing unit, and 4 is a reproduction processing unit, the sound collection device 1 comprising sound-collecting microphones $I_1$ to $I_M$.

The digital signal processing unit 2 comprises control filters $H_{11}$ to $H_{MN}$ which are connected to the output sides of the sound-collecting microphones $I_1$ to $I_M$ respectively. In other words, control filters H in a number corresponding to the number of reproduction channels N are connected to each of the sound-collecting microphones $I_1$ to $I_M$. In addition, the control filters H used for the respective channels which are connected to the respective microphones are connected to the adders $\Sigma_1$ to $\Sigma_N$ used for the respective reproduction channels.

The respective control filters $H_{11}$ to $H_{MN}$ of the digital signal processing unit 2 have a directivity control unit 21 for inputting control data for determining the directivity of the sound-collecting microphones $I_1$ to $I_M$ connected thereto. In other words, in order to perform sound collection with an emphasis on a sound which is produced in a desired direction and position among the sounds which are recorded in the sound field by the respective sound-collecting microphones $H_{11}$ to $H_{MN}$, the directivity control unit 21 inputs the direction and position as control data to the digital signal processing unit 2.

The directivity control unit 21 has control data directly input thereto manually by the user via the encoder and keyboard and so forth and has control data which change as time elapses input thereto by the computer program. In this case, q control points for measuring the desired response and one or a plurality of locations for the control points with which the desired response is obtained by subjecting the control points to a supplementary calculation are designated as the directivity control data to be input.

For example, only one control point may be designated in cases where the output channel is a single channel, and control points of a quantity and direction corresponding to the quantity and direction of the output channels are input as control data in cases where there are multiple channels. FIG. 5 shows a state where microphone directivity is established in five directions around the microphones M1 to M4 shown in FIG. 1 for the use of a 5-channel reproduction system and where sound collection takes place with an emphasis on the sounds in these directions.

When control points from which sound collection is to be performed are input by the operator, the directivity control unit 21 performs a calculation to determine the values of the respective control filters $H_{11}$ to $H_{MN}$ in accordance with the algorithm shown in (2) on the basis of the desired response transfer function matrix A(ω) and transfer function matrix C(ω) pertaining to the control points obtained from measurement values and outputs the calculation result to the digital signal processing unit 2.

The monitoring processing unit 3 comprises two-channel monitoring output units $O_1$ and $O_2$ such as headphones or two-channel speakers. The signals from the adders $\Sigma_1$ to $\Sigma_N$ of the respective reproduction channels are output via a virtual sound source reproduction processing unit 31 to the monitoring output units $O_1$ and $O_2$.

In other words, the virtual sound source reproduction processing unit 31 divides the signals from the adders $\Sigma_1$ to $\Sigma_N$ of the respective reproduction channels into left and right speakers or headphones and, after the left and right signals resulting from the division have been transmitted by each of the control filters $S_1$, $C_1$ to $S_n$, and $C_n$, adds the outputs of the right-hand control filters $S_1$ to $S_n$ of the respective reproduction channels by means of the adder $\Sigma_{O1}$ before outputting the result to the monitoring output unit $O_1$ and adds the outputs of the left-hand control filters $C_1$ to $C_n$ of the respective reproduction channels by means of the adder $\Sigma_{O2}$ before outputting the result to the monitoring output unit $O_2$.

In this case, because the control filters $S_1$, $C_1$ to $S_n$, and $C_n$ have different filter coefficients depending on the device such as speakers or headphones used as monitoring output units $O_1$ and $O_2$, signals which are adapted to listening using both ears of the listener are generated for each device.

In addition, the monitoring processing unit 3 is provided with the channel designation unit 32 for designating whether sound is to be monitored on either channel in cases where predetermined control points at which sound is to be collected are designated by the digital signal processing unit 2. The channel designation unit 32 designates only the signal of the channel being monitored among the signals of the respective channels output by the digital signal processing unit 2 and inputs this signal to the virtual sound source reproduction processing unit 31.

Reproduction processing unit 4 has reproduction output units $O_1$ to $O_N$ for the respective channels which output the signals of the respective channel adders $\Sigma_1$ to $\Sigma_N$ of the digital signal processing unit 2. The reproduction output units $O_1$ to $O_N$ are connected to the inputs of arbitrary reproduction systems such as a stereo system, a 5.1-channel surround system, or a virtual sound source reproduction processing unit.

(4) Action of this Embodiment

The action of the sound collection/reproduction system of this embodiment which is constituted as described hereinabove is as follows. First, prior to the sound collection, a plurality of each of the sound collection devices are arranged in the sound field space in a state of proximity to one another and a plurality of control points are set around the sound collection devices. In this state, the desired response function matrix $A(\omega)$ and the transfer function matrix $C(\omega)$ between the respective control points and the sound collection devices are determined from the measurement values by using each of the sound collection devices to record the sounds which are produced from each of these control points and the desired response function matrix $A(\omega)$ and the transfer function matrix $C(\omega)$ are stored in the directivity control unit 21.

However, each time the reproduction processing is carried out, it is determined on how many channels reproduction is to be performed, whereupon the corresponding quantity of reproduction devices is prepared for the reproduction processing unit 4 and connected to the reproduction output units $O_1$ to $O_N$ of the respective channels provided in the reproduction device digital signal processing unit 2. The control filters $H_{11}$ to $H_{MN}$ are also prepared in the quantity corresponding to the number of reproduction channels for each of the sound collection devices $I_1$ to $I_M$ which are arranged in proximity to one another.

There is no need to determine the number of reproduction channels beforehand. The sounds recorded by each of the sound collection devices are stored in a storage device and, after the number of reproduction channels has been determined, the digital signal processing unit 2 which comprises the required number of control filters and adders as well as the reproduction devices can also be prepared.

In this state, the sounds recorded by each of the sound collection devices $I_1$ to $I_M$ are input to the control filters $H_{11}$ to $H_{MN}$ which are connected in a quantity corresponding to the number of channels to each of the sound collection devices.

Here, when the operator makes an input to the directivity control unit 21 indicating that sound collection is to be performed with an emphasis on sound in a particular direction, a control point which is obtained by measuring the desired response function and transfer function beforehand (or determined through calculations from the measurement values) is selected by the directivity control unit 21 on the basis of the direction and position thus input (the distance from the sound collection device), whereupon the directivity control unit 21 calls the desired response function matrix and transfer function matrix for the control point q and, by substituting the desired response function matrix and transfer function matrix in Equation 3, the values of the control, filters $H_{11}$ to $H_{MN}$ are found by way of calculation.

In this case, because the distance and direction differ between the respective sound collection, devices $I_1$ to $I_M$ and control points q, the desired response function and transfer function also differ. In addition, in cases where there is a plurality of reproduction channels, the direction of the directivity afforded to the sound collection devices for each channel (the direction in which the sound collection device performs sound collection with emphasis) differs and the values of the respective control filters are also different.

Thus, when the values of the respective control filters are determined, only the sound in the desired direction among the sounds of the respective sound collection devices is emphasized for each channel by the control filters $H_{11}$ to $H_{MN}$. Thereafter, the signals from the respective control filters are added by the adders $\Sigma_1$ to $\Sigma_N$ for each channel and the result is output from the output unit reproduction units $O_1$ to $O_N$ of the respective channels to the reproduction devices of each channel.

According to this embodiment, a designation of the channel to be monitored is issued by the channel designation unit 32 to the monitoring processing unit 3 in order to perform reproduction channel monitoring. Thus, only the signal of the desired channel is selected from among the signals of the adders $\Sigma_1$ to $\Sigma_N$ of the respective channels which are provided in the digital signal processing unit and this signal is output to two-channel speakers or headphones which constitute the monitoring reproduction device via the control filters $S_1$, $C_1$ to $S_n$, and $C_n$. In this case, the optimum output can be obtained irrespective of the type of reproduction device by setting the coefficients of the control filters $S_1$, $C_1$ to $S_n$, and $C_n$ in accordance with the reproduction device which is making the output.

(5) Effect of the Embodiment

As mentioned earlier, this embodiment makes it possible to perform extraction with an emphasis on only the sound in the desired direction from among the collected sounds and reproduce the sound by collecting all of the sounds received in the sound field space and using a control filter to process these collected sounds without giving a particular directivity to the plurality of sound collection devices themselves.

In particular, because it is determined, using control data supplied to the control filters, which sound in which direction is emphasized in the sound reproduction, a sound collection/reproduction system with a high degree of freedom with which it is possible to freely determine the direction in which the sound is collected and the number of reproduction channels by changing the control data and which is not limited to parallel planar waves such as those of the prior art but rather which is also compatible with spherical waves with an arbitrary curvature.

Furthermore, the present invention finds the desired response and transfer function for preset control points q by measuring same or calculating same on the basis of the measurement values and determines control filters on the basis of the data based on the measurement values. Hence, even in cases where the directivity is applied in either direction of the sound collection device, an output which is an approximation of the desired response can be obtained by using an approximation method such as the least-squares method to solve the inverse matrix $[C(\omega)^T \cdot C(\omega)]^{-1}C(\omega)^T$ of the transfer function matrix C constituting the control filters H.

In addition, the sound collection direction that is input to the directivity control unit 21 can also be set manually by the operator. However, a value which varies moment by moment as time elapses can also be input by means of a computer program or the like. In this case, the values of the control filters $H_{11}$ to $H_{MN}$ change as the control data thus input vary and a sound in the desired direction can be output to the desired channel.

In addition, this embodiment is constituted such that the outputs from the digital signal processing unit 2 are introduced to the monitoring processing unit 3 before being output to a two-channel reproduction device. Hence, the outputs to the reproduction channels can both be distinguished clearly from another channel sound and heard simply by operating the channel selection unit 32 provided in the monitoring processing unit 3. Naturally, although only the sound of a single reproduction channel can be monitored in this case also, the sounds of a plurality of channels which are output by the adders $\Sigma_1$ to $\Sigma_N$ can also be simultaneously output to the monitoring device.

BRIEF DESCRIPTION OF THE DRAWINGS

FIG. 1A is a side view and FIG. 1B is a front view;

LIST OF ELEMENTS

Figure 1:
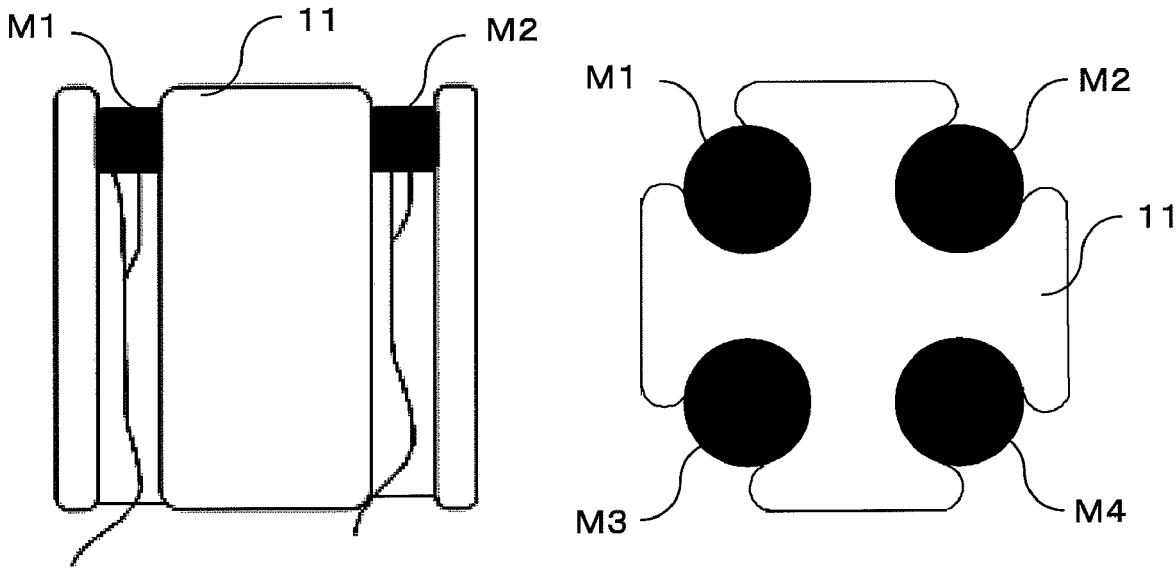
FIG. 1 shows a constitutional example of a microphone used by the present invention, where
Figure 2:
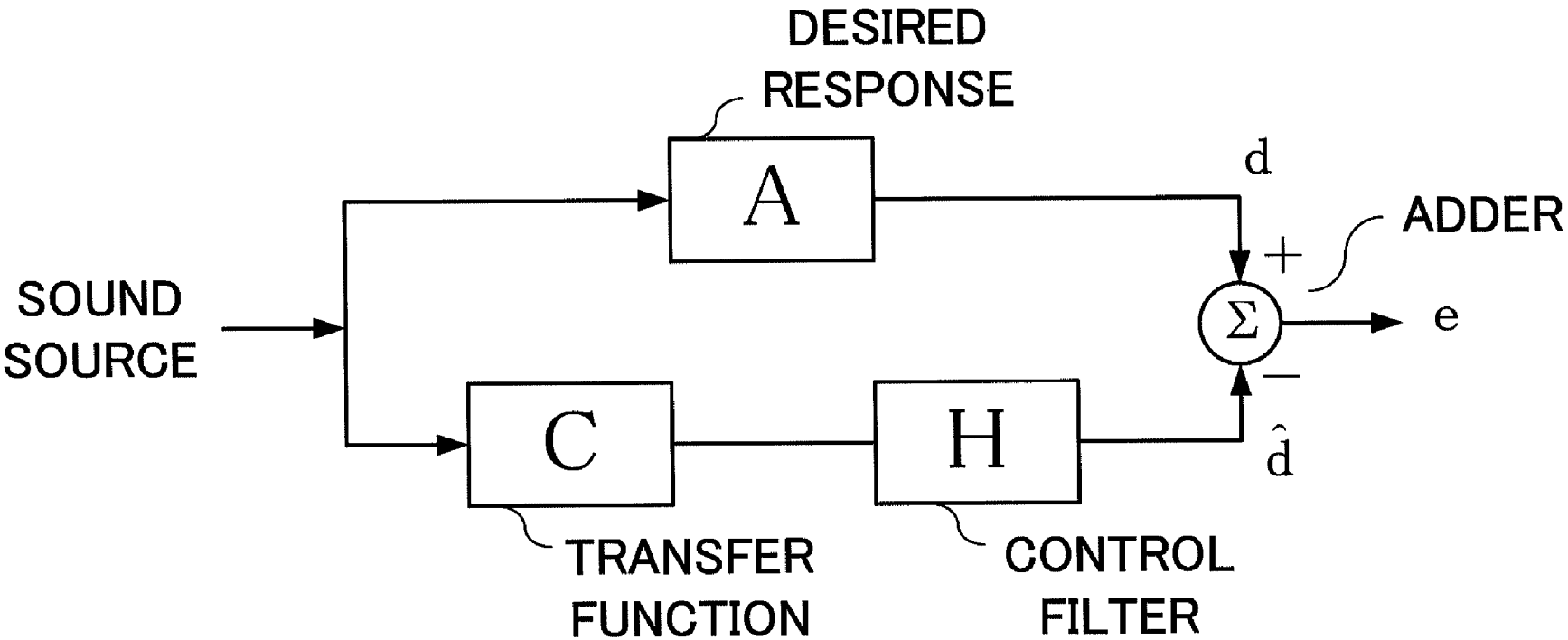
FIG. 2 is a reproduction equalizing circuit diagram which shows an algorithm for obtaining a control filter H constituting the sound collection system of the present invention.
Figure 3:
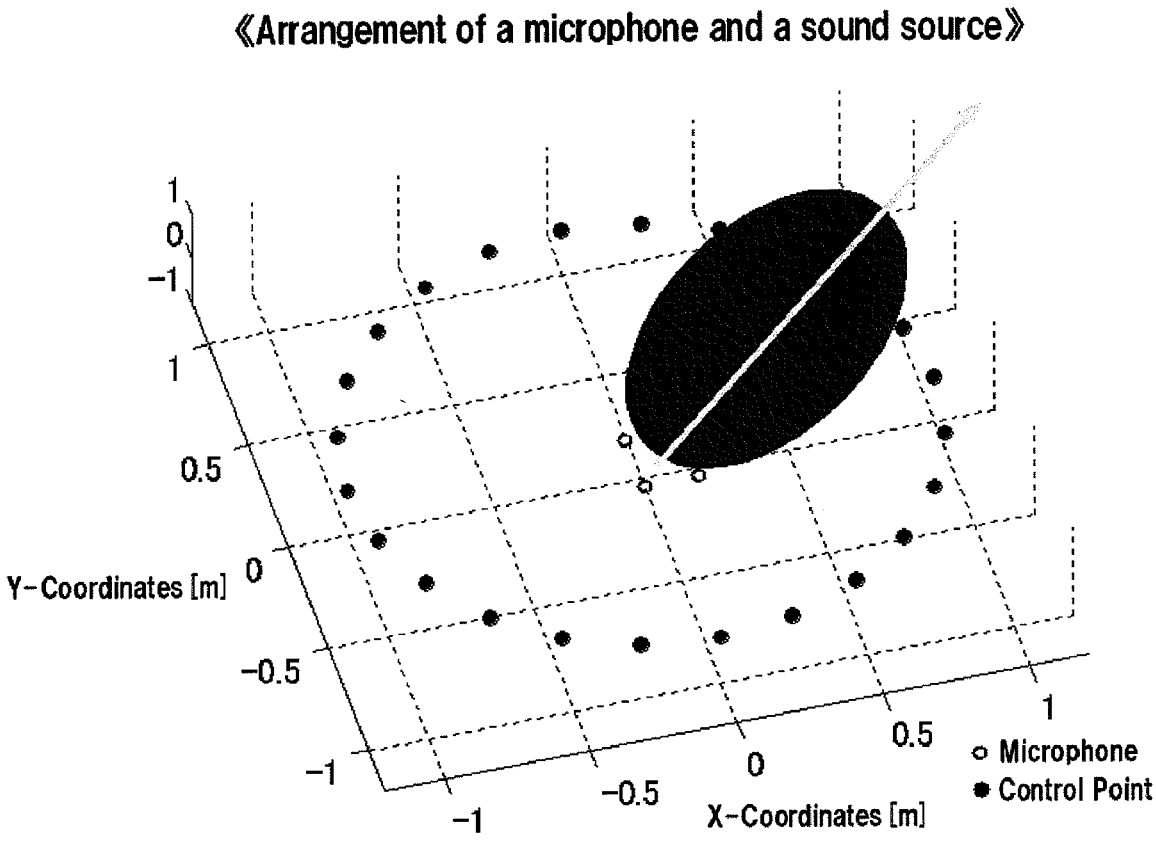
FIG. 3 shows a state where the desired response of the present invention is set in a sound field space.
Figure 4:
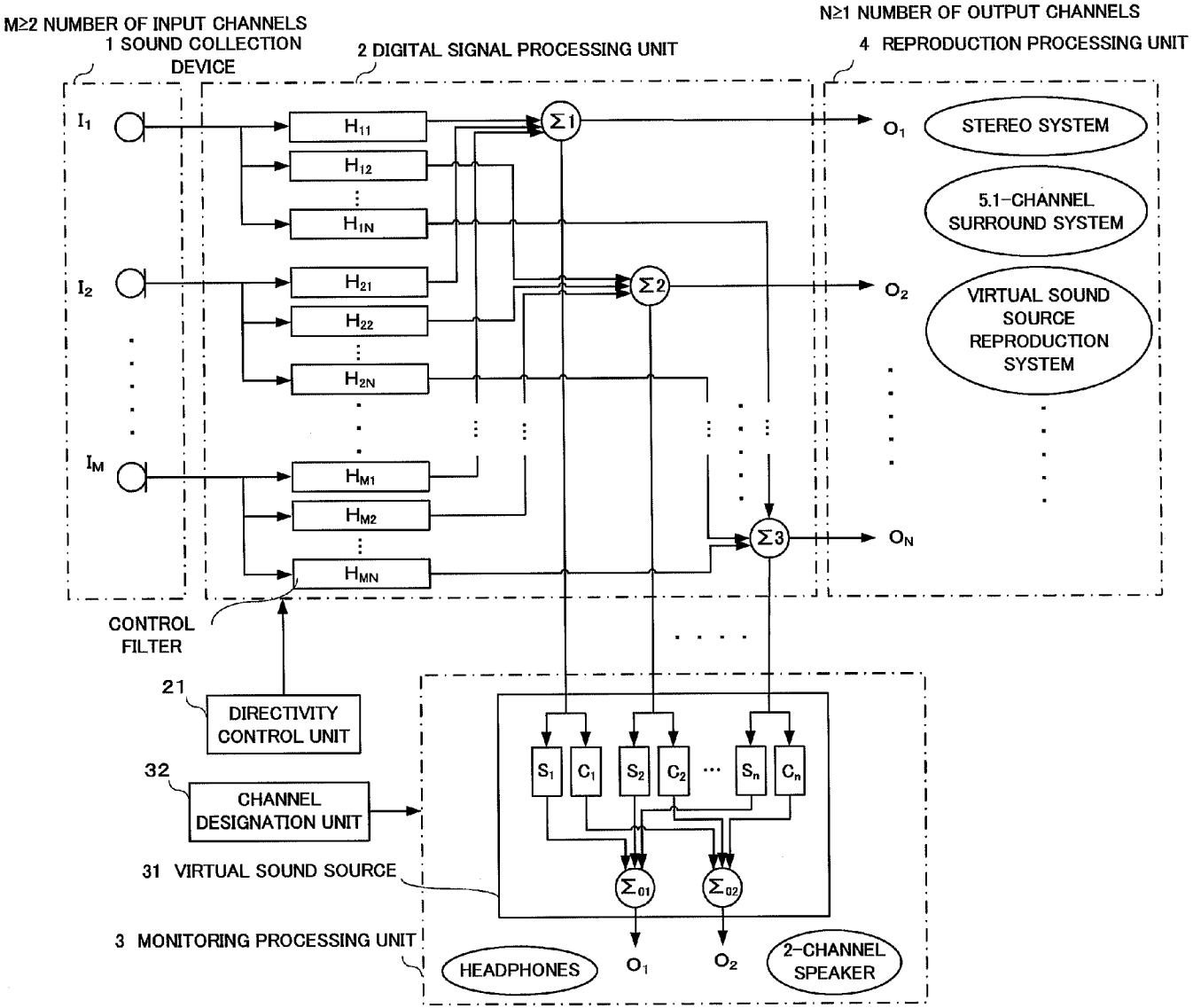
FIG. 4 is a block diagram showing an embodiment of the sound collection system of the present invention.
Figure 5:
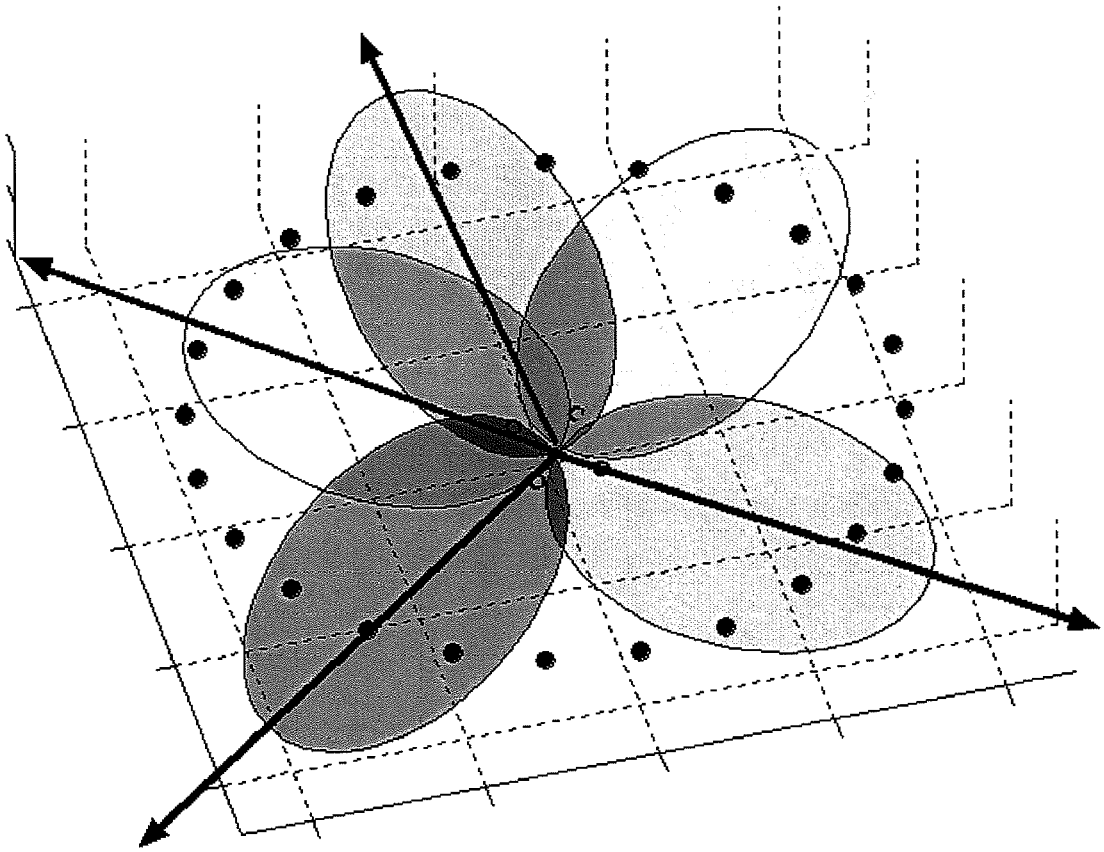
FIG. 5 shows a state where directivity is set in five directions around the microphone.
Figure 6:
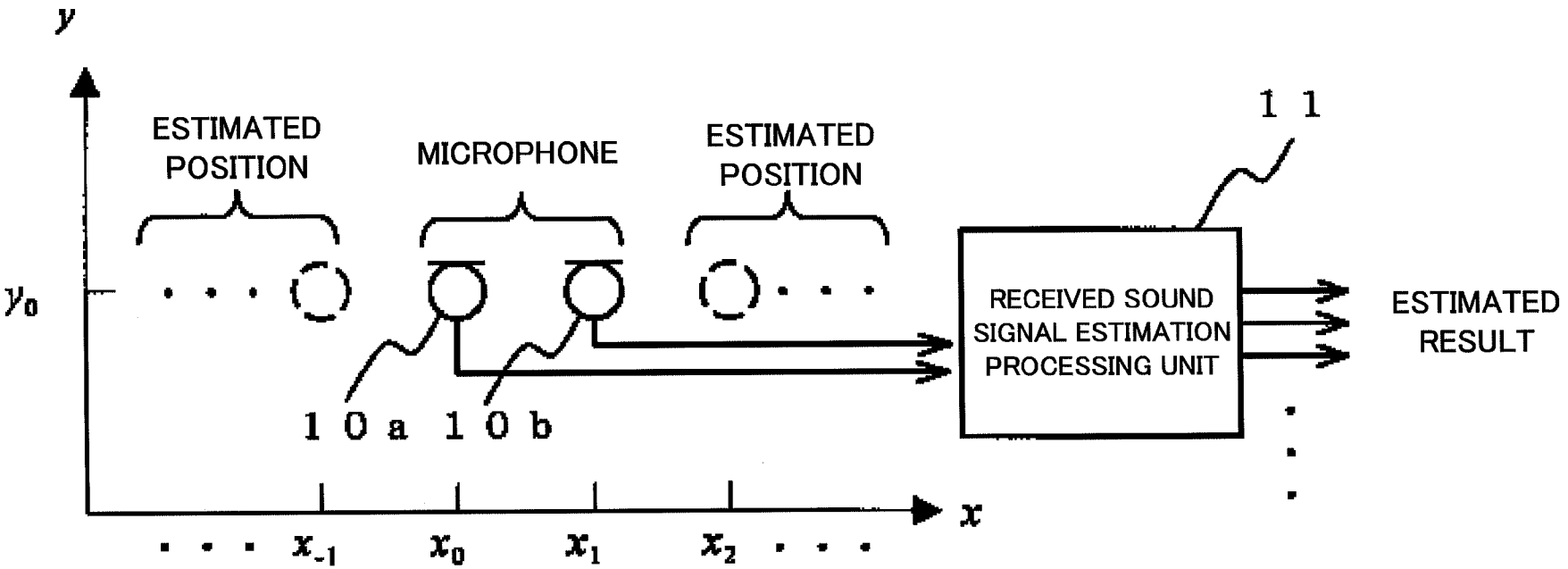
FIG. 6 is a block diagram showing an example of a conventional sound collection system.

M1 to M4 . . . microphone 1 . . . sound collection device 2 . . . digital signal processing unit 21 . . . directivity control unit 3 . . . monitoring processing unit 31 . . . virtual sound source reproduction processing unit 32 . . . channel designation unit 4 . . . reproduction processing unit A . . . desired response C . . . transfer function H . . . control filters $I_1$ to $I_M$ . . . sound-collecting microphones $H_{11}$ to $H_{MN}$ . . . sound collection system control filters $\Sigma_1$ to $\Sigma_N$ . . . adders $O_1$ to $O_N$ . . . reproduction output units $S_1$, $C_1$ to $S_n$, $C_n$ . . . control filters $O_1$, $O_2$ of virtual sound source reproduction processing unit . . . monitoring output unit

The invention claimed is:

1. A sound collection and reproduction device comprising:

a plurality of sound collection devices arranged in proximity to one another;

a digital signal processing unit which processes sounds collected by each of the sound collection devices; and a reproduction output unit which outputs a speech signal which is output by the digital signal processing unit, wherein the reproduction output unit is provided with reproduction devices of one or a plurality of channels, the digital signal processing unit is provided with control filters in a number corresponding to the number of reproduction channels connected to each of the plurality of sound collection devices, and adders in a number corresponding to the number of channels, which add the outputs of the control filters of each of the reproduction channels connected to each of the sound collection devices for each channel, the outputs of the adder of each of the channels being connected to the reproduction device of each of the channels of the reproduction output unit, the control filters are obtained by setting a plurality of control points in a sound field around the plurality of sound collection devices arranged in proximity to one another, determining a desired response function matrix and a transfer function matrix between the control points and each of the sound collection devices on the basis of measurement values, and, in cases where the directivity of the sound collection devices is designated, determining values of the control filters on the basis of the desired response function matrix and transfer function matrix between the control points corresponding to the designated directivity and each of the sound collection devices, and the digital signal processing unit is provided with a directivity control unit to which directivity control data are input in order to determine the directivity during sound collection by controlling the control filters wherein each of the control filters is represented by $H(\omega)=[C(\omega)^T \cdot C(\omega)]^{-1}C(\omega)^T \cdot A(\omega)$, where the control filter matrix is $H(\omega)$, the desired response function matrix is $A(\omega)$, and the transfer function is $C(\omega)$, and is obtained by solving the inverse matrix $[C(\omega)^T \cdot C(\omega)]^{-1}C(\omega)^T$ of the transfer function matrix $C(\omega)$.

2. The sound collection and reproduction device according to claim 1, further comprising:

a monitoring processing unit connected to the digital signal processing unit, wherein the monitoring processing unit being provided with a virtual sound source reproduction processing unit which converts the signal from the adder of each of the channels provided in the digital signal processing unit into an output signal of a two-channel monitoring output unit.

3. The sound collection and reproduction device according to claim 2, wherein the virtual sound source reproduction processing unit comprises:

an additional control filter which divides the outputs from the adder of each of the channels provided in the digital signal processing unit into two to match two left and right channels of the two-channel monitoring output unit, and sets a filter coefficient corresponding to the two-channel monitoring output unit for each of the two divided left and right signals of each of the channels;

left and right adders which add the outputs from the additional control filter; and an output unit which outputs signals from the left and right adders to each of the channels of the two-channel monitoring output unit.

4. A sound collection and reproduction method, according to which a plurality of sound collection devices are arranged in proximity to one another, control filters in a number corresponding to the number of reproduction channels are connected to each of the sound collection devices, and the output signals from the control filters of each of the channels are added for each of the channels and output from each of the reproduction channels, the method compromising:

collecting sounds by a plurality of sound collection devices, setting a plurality for control points in a sound field around the plurality of sound collection devices, providing directivity control data in order to determine the directivity during sound collection by controlling the control filters, determining a desired response function matrix and a transfer function matrix of the control filters between the control points and each of the sound collection devices on the basis of measurement values, determining values of the control filters on the basis of the desired response function matrix and transfer function matrix between the control points corresponding to the designated directivity and each of the sound collection devices to produce a control filter matrix, filtering the collected sounds based on the control filter matrix by the control filters to produce filtered output signals, adding the filtered output signals from the respective control filters for the respective reproduction channels, and outputting the added filtered output signals to a reproduction output unit, wherein the values of the control filters are determined in accordance to the $$H(\omega)=[C(\omega)^T\cdot C(\omega)]^{-1}C(\omega)^T\cdot A(\omega),$$

where the control filter matrix is H (ω), the desired response function matrix is A (ω), and the transfer function is C (ω), and is obtained by solving the inverse matrix $[C(\omega)^T\cdot C(\omega)]^{-1}C(\omega)^T$ of the transfer function matrix C(ω).

5. The sound collection and reproduction method of claim 4, further comprising:

monitoring and extracting one or more of the added filtered output signals, the extracted signal is output to a two-channel monitoring output unit via a virtual sound source reproduction processing unit.

6. The sound collection and reproduction method according to claim 5, wherein the virtual sound source reproduction processing unit divides the signals of each of the channels for use as left and right output signals of the two-channel monitoring output unit, and outputs the divided left and right signals of each of the channels to left and right reproduction devices via additional control filters conforming to the characteristic of the two-channel monitoring output unit.

* * * * *